US005245766A

United States Patent [19]

Warren

[11] Patent Number: 5,245,766

[45] Date of Patent: Sep. 21, 1993

[54] IMPROVED CUSHIONED SHOE SOLE CONSTRUCTION

[75] Inventor: David E. Warren, North Windham, Me.

[73] Assignee: Nike, Inc., Beaverton, Oreg.

[21] Appl. No.: 860,283

[22] Filed: Mar. 27, 1992

Related U.S. Application Data

[63] Continuation of Ser. No. 501,478, Mar. 30, 1990, abandoned.

[51] Int. Cl.[5] ..... A43B 13/20; A43B 13/18

[52] U.S. Cl. ..... 36/29; 36/28; 36/30 R

[58] Field of Search ..... 36/30 R, 28, 29, 25 R, 36/27, 35 R, 35 B, 24.5, 107, 108, 43, 44

[56] References Cited

U.S. PATENT DOCUMENTS

| | | | |
|---|---|---|---|
| 302,190 | 7/1884 | Butterfield | |
| 712,437 | 10/1902 | Schermerhorn | |
| 840,170 | 1/1907 | Story | |
| 1,195,151 | 8/1916 | Prenzel | 36/27 |
| 1,282,399 | 10/1918 | Egerton | 36/30 R |
| 1,716,364 | 6/1929 | Avery | |
| 1,751,990 | 3/1930 | Gilkerson | 36/28 |
| 1,751,991 | 3/1930 | Gilkerson | 36/28 |
| 1,754,225 | 4/1930 | Eaton | |
| 1,913,025 | 6/1933 | Gilkerson | 36/28 |
| 1,920,112 | 7/1933 | Shaft | 36/28 |
| 1,942,883 | 1/1934 | Schaffer | 36/29 |
| 1,967,956 | 7/1934 | Lowey | 36/17 |
| 1,968,290 | 7/1934 | Gilkerson | 36/19 |
| 1,976,389 | 10/1934 | Everston | 36/28 |
| 2,049,227 | 7/1936 | Rohn et al. | 36/28 |
| 2,109,180 | 2/1938 | Mohun | 36/29 |
| 2,111,620 | 3/1938 | Gilkerson | 36/28 |
| 2,131,375 | 9/1938 | Holland | 12/142 |
| 2,135,135 | 11/1938 | Gilkerson | 36/37 |
| 2,222,391 | 11/1940 | Andreasen | 36/28 |
| 2,397,316 | 3/1946 | Horvit | 36/19.5 |
| 2,502,774 | 4/1950 | Alianiello | 36/28 |
| 2,523,702 | 9/1950 | LaChapelle | 36/28 |
| 2,917,843 | 12/1959 | Scholl | 36/71 |
| 3,133,360 | 5/1964 | Taylor | 36/17 |
| 3,253,355 | 5/1966 | Menken | 36/29 |
| 3,408,753 | 11/1968 | Bolen | 36/2.5 |
| 4,463,505 | 8/1984 | Duclos | 36/30 R |
| 4,906,502 | 3/1990 | Rudy | 428/69 |
| 4,908,962 | 3/1990 | Yung-Mao | 36/30 R |
| 4,930,232 | 6/1990 | Engle | 36/44 |
| 4,942,679 | 7/1990 | Brandon | 36/102 |

FOREIGN PATENT DOCUMENTS

| | | | |
|---|---|---|---|
| 2214777 | 9/1989 | United Kingdom | 36/28 |

*Primary Examiner*—Steven N. Meyers

*Attorney, Agent, or Firm*—Banner, Birch, McKie & Beckett

[57] ABSTRACT

A shoe sole including an outsole having forepart, arch and heel portions and a substantially flat cushioning element disposed above the outsole heel portion. The cushioning element defines a chamber which is pressurized with a fluid. Also included is an insole, disposed above the outsole forepart and arch portions of said outsole and directly adjacent the pressurized cushioning chamber. Further, a top of the pressurized cushioning chamber does not extend materially above a top of the directly adjacent insole.

12 Claims, 2 Drawing Sheets

IMPROVED CUSHIONED SHOE SOLE CONSTRUCTION

This application is a continuation of application Ser. No. 07/501,478, filed Mar. 30, 1990, now abandoned.

TECHNICAL FIELD

This invention relates to an improved cushioning shoe construction. In particular, it concerns a relationship between cushioning elements and the insole which can result in a thin shoe sole, for example for a dress shoe, with excellent cushioning properties.

BACKGROUND OF THE INVENTION

When constructing a shoe sole, especially those for conventional dress shoes, there is usually little cushioning in the forepart and no cushioning in the heel part of the sole. For example, in a conventional sole for men's dress shoe, the sole includes an outsole and a full sole covering the forepart, arch and heel portions of the outsole. For cushioning, sometimes the full insole has a forepart cavity filled with cork. The thickness of the outsole and insole of this conventional dress shoe is normally no thicker than 11 mm and usually 7–9 mm in thickness.

The lasting margin is the break line between the connection of the outsole to the upper. Normally, the insole or innersole board runs along this lasting margin. For a proper fit inside the shoe, normally only a thin sockliner assembly is above the lasting margin.

Although many have tried to improve cushioning in the heel portion of minimal thickness shoe soles, the result has normally been a tradeoff in the look of the shoe. Attempts to add separate cushioning elements to the heel portion of a sole, especially to the sole of a dress shoe, often result in increasing the thickness of the sole to a sole thickness normally associated with an athletic, walking or orthopedic shoe. Thus, the shoe does not have the minimal thickness sole look which consumers expect of dress shoes. For examples of this problem, see U.S. Pat. No. 3,253,355 to Menken, U.S. Pat. No. 1,942,883 to Shaffer and U.S. Pat. No. 302,190 to Butterfield.

Alternatively, the sole may appear to be the same thickness on the outside, but the cushioning elements or a portion of the insole over the cushioning elements often extend well above the lasting margin into the inside of the shoe. When a cushioning element causes the sole to materially project above the lasting margin at the heel portion of the sole, often the comfort of the fit of the shoe is sacrificed. To try and accommodate the fit problem, often the upper is made taller or otherwise expanded. As with the tradeoff of an increased thickness sole, the resulting increased size of an upper can change the look of a dress shoe away from consumer's expectations.

Examples of the increased cushioning causing projections at the top of the heel portion of the sole are found in U.S. Pat. No. 2,502,774 to Alianiello, U.S. Pat. No. 2,135,135 to Gilkerson et al. and U.S. Pat. No. 840,170 to Story. In U.S. Pat. No. 2,502,774 to Alianiello, holes are cut in the heel and forepart portions of the full insole so that the shoes are not more bulky than shoes of standard construction. However, as illustrated in Alianiello's drawings, the shoe sole has an increased thickness at least in the heel portion of the sole, because a sponge rubber cushioning element rests on a shelf of the insole.

Also, cork is added between the sponge rubber and the outsole to obtain the total desired cushioning effect. By obtaining the cushioning with the rubber on the shelf of the insole and with the cork, Alianiello may introduce the problem of shoe fit and may possibly require a modified or expanded upper to address this problem.

SUMMARY OF THE INVENTION

The present invention was designed to avoid the tradeoffs which are made in the known prior art having soles with cushioned heel portions. In particular, the present invention is directed to obtaining a high degree of cushion or springiness in the sole without having to materially change the look of the upper or sole of conventional shoes having minimum thickness soles.

The invention relates to an improved construction for obtain excellent cushioning properties within the design constraint of soles of relatively minimum thickness. It includes an outsole having forepart, arch and heel portions, and a substantially flat cushioning element disposed above the outsole heel portion. The cushioning element preferably defines a chamber which is pressurized with a fluid. An insole is disposed above the arch and forepart sections of the outsole and is directly adjacent the cushioning chamber. A top of the cushioning chamber does not, however, extend materially above a top of the adjacent partial insole. Thus, in the present invention, one can obtain excellent cushioning properties in a thin sole shoe without introducing the tradeoff of an improper fit or an undesirable shoe appearance.

Various advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described preferred embodiments of the invention.

DETAILED DESCRIPTION OF THE INVENTION

Figure 1:
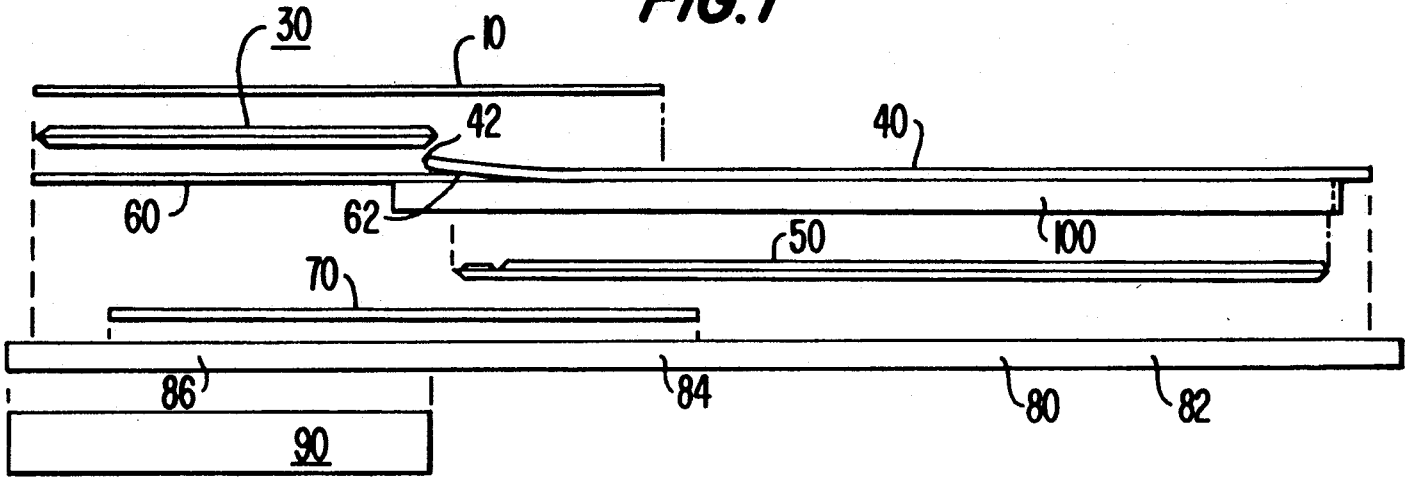
FIG. 1 is an exploded side view of a cushioned shoe sole in accordance with this invention.

Referring to the drawings, wherein like numerals indicate like elements, a shoe sole, in accordance with the present invention, is generally shown as 5 in FIG. 1. As illustrated in FIG. 1, the sole 5 includes an outsole 80 having forepart 82, arch 84 and heel 86 portions. A heel 90 is affixed to a bottom of heel portion 86 of outsole 80. A tuckboard 60 is disposed above and preferably directly on outsole heel portion 86. The tuckboard adds very little thickness to the sole. It is preferably no more than 2 mm thick and its function is primarily for holding nails from heel 90.

A steel shank 70 is at least partially disposed under the tuckboard. Sole 5 also comprise a sockliner assembly 10 which is partially shown in FIGS. 1 and 2. This assembly is disposed or affixed on top of a cushioning element 30 and on top of an insole or innersole board 40. Although not shown in such detail, sockliner assembly 10 preferably includes a 1 mm thick canvas pad placed directly on cushioning element 30 and on the insole. Although using a 2 mm thick foam pad instead of the canvas pad is an alternative, the Applicant prefers a 1 mm thick canvas pad for a better bond between the cushioning element and the sockliner assembly. Sockliner assembly 10 also includes a soft leather cover on top of the foam.

Figure 2:
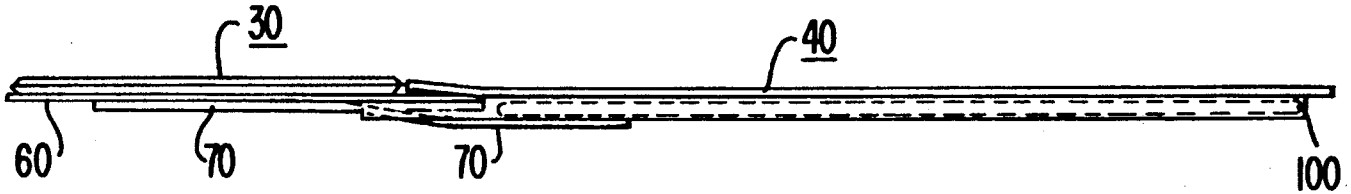
FIG. 2 is a side view of elements of the cushioned shoe sole of FIG. 1.
Figure 3:
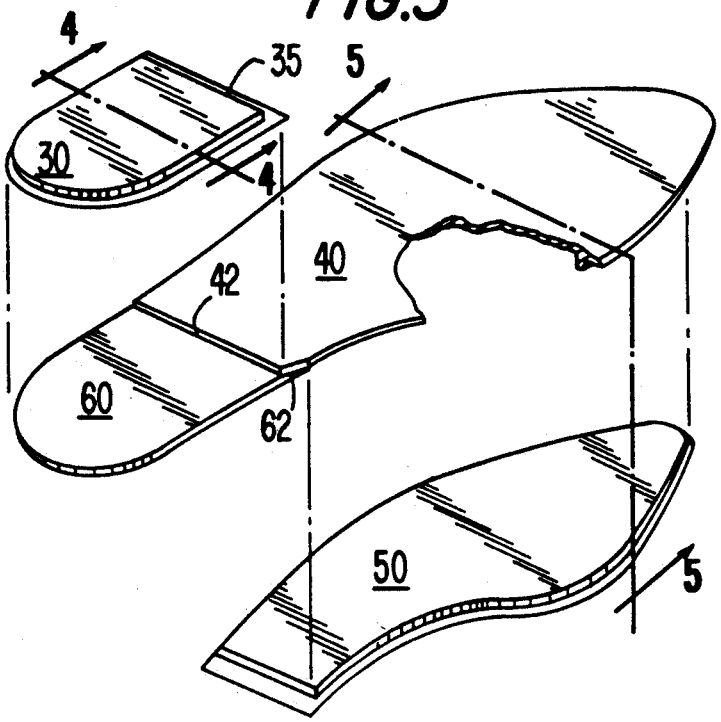
FIG. 3 is a perspective view of an insole, tuckboard and rib of FIGS. 1 and 2 with heel and forepart cushioning elements of FIGS. 1 and 2 exploded therefrom.

Cushioning element 30 is disposed above heel portion 86 of outsole 80 and is preferably disposed on tuckboard 60. As seen in FIGS. 1-3, heel cushioning element 30 covers a substantial portion of tuckboard 60. A cushioning element is desired under the heel of the wearer of the shoe, because under the heel of the wearer is where cushioning is most needed to absorb shocks to which the foot is subjected.

Generally this cushioning element 30 provides a high degree of shock attenuation in a very low profile. In particular, it is substantially flat and of a substantially uniform thickness of approximately 4 mm and no greater than 5 mm.

Figure 4:
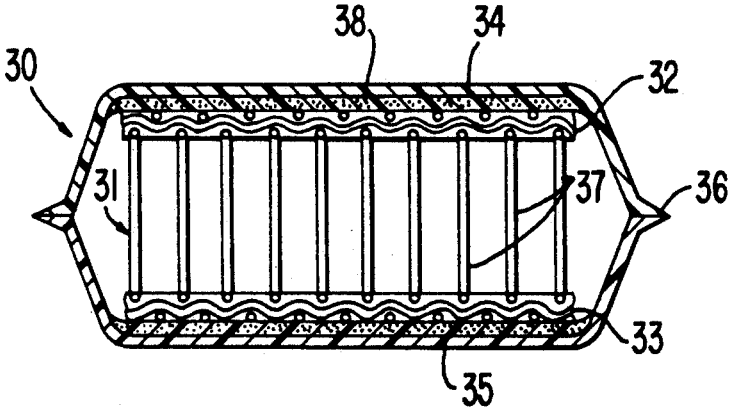
FIG. 4 is an enlarged sectional view along line 4—4 of FIG. 3 showing the heel cushioning element of FIGS. 1–3.

Heel cushioning element 30 is preferably formed as a chamber which is pressurized with a fluid to provide improved cushioning properties. Having a pressurized chamber avoids an unwieldy bulge which may occur when a compressive force is placed on top of unpressurized air vented cushions. As seen in FIG. 4, preferred pressurized cushioning chamber 30 is tightly sealed by means of weld 36. By having a properly sealed chamber, a seepage problem commonly found with sponge rubber cushions can be avoided.

The preferred pressurized cushioning chamber is pressurized to a level such that more than 40% of the energy of impact on the structure is returned in a beneficial, efficient and comfortable manner rather than being absorbed and dissipated in heat. The most preferable cushioning element is a lightweight pressurized tensile air chamber as shown in FIG. 4 and described in U.S. Pat. No. 4,906,502 to Marion F. Rudy, entitled "Pressurizable Envelope and Method," issued Mar. 6, 1990, which is hereby incorporated by reference. This tensile air chamber provides the preferred amount of resilience to the heel portion of the sole. In particular, this preferred tensile air cushioning chamber 30 of FIG. 4 defines a pressure tight sealed chamber of polyurethane in which a tensile load-bearing structure is positioned. Chamber 30 includes a double-walled thread linked fabric structure 31 having a first fabric layer 32, a second fabric layer 33 and drop threads 37. It is this multilayered fabric structure 31 which holds top 34 and bottom 35 surfaces of the cushioning chamber or envelope in tension and substantially flat even when said cushioning chamber is pressurized. In addition, a zone 38 is shown as the portion of the chamber 30 which is rendered molten for purposes of bonding with a bonding agent. Note, however, other cushioning devices could be substituted for the most preferred tensile air chamber such as a cushion having gels or springs.

It is important that the back height of the conventional sole does not materially change even with cushioning element 30 added. Keeping the height or thickness of the conventional sole from materially changing with this cushioned sole construction is very important to the look of a minimum thickness sole, especially to the look of a sole for a dress shoe. To allow the added cushioning properties to be included in such a sole, insole or innersole board 40 is disposed above forepart 82 and arch 84 sections of the outsole. It is also directly adjacent heel cushioning chamber 30. Although the arch portion of the insole can be of many shapes and widths, the use of the term arch portion of the insole herein refers generally to the many shapes and widths of outsole portions between the forepart and heel portions of the sole.

The insole is preferably disposed only above the arch and forepart areas of the outsole and not the heel of the outsole. Although relatively stiff leather insole 40 could, for example, go around a perimeter of heel cushioning element 30, it is more preferable that insole 40 not be disposed over heel section 86 of the outsole. By cutting away or preferably removing the insole from the heel portion of the sole and placing the cushioning element on relatively the same level as the insole (as opposed to on top of the insole or on a shelf of the insole), the back height of the shoe sole does not materially change relative to the back height of conventional minimum thickness shoe soles.

In particular, it is preferred that insole 40 has a rearwardmost portion defining a substantially planar end 42 extending substantially across the width of the outsole so that insole 40 extends no further rearward on outsole 80 than a forwardmost portion of weld 36 of cushioning element 30. This structure leaves a substantial portion of the heel available for shock absorption by heel cushioning element 30.

This partial insole 40 and heel cushioning element 30 combine to provide the improved cushioning properties without materially adding to the height of the sole. The preferred partial insole is approximately 1-3 mm thick at its rear end 42. The substantially flat cushioning element 30 preferably has a forwardmost portion 36 defining a line extending substantially across the width of the outsole and being directly adjacent the insole rearwardmost end 42. Thus, cushioning element 30 abuts, but does not overlap insole 40. With this non-overlapping relationship of the partial insole to the cushioning element and with the relatively thin profiles of each of the partial insole and the cushioning element, the shoe can be constructed so that the top portion of cushioning element 30 does not extend materially above a top of the adjacent partial insole. In other words, it is preferred that the shoe be constructed so that the top surface of cushioning element 30 is substantially flush with a top surface of insole 40 where insole and the cushioning element are adjacent to each other.

In particular, cushioning element 30 is preferably no more than 2 mm thicker than insole 40. Thus, the addition of the cushioning element to the heel portion of the sole does not materially change the thickness of the sole of the present invention relative to the thickness (no more than 11 mm) of a sole for a conventional dress shoe. To more preferably accomplish this minimum sole thickness design constraint, cushioning element 30 is no more than 1 mm thicker than the adjacent partial insole 40.

One reason this invention improves the cushioning with minimal thickness soles is because the relatively thin cushioning element 30 is not a comfort add on. It is part of the construction. As seen in FIG. 1, by going from a full length of the sole insole to a partial insole 40 and by placing the cushioning element 30 on substantially the same level as the insole, the back height of the shoe sole does not materially change when the sole of the present invention has cushioning element 30 added therein. This maintaining of a minimal thickness sole without the tradeoff of having to change the fit of the shoe or the look of the upper is very important to the consumer's acceptance of this type of sole.

The new construction method designed to accommodate heel cushioning element 30, preferably a tensile air chamber, includes the steps of affixing, preferably by adhesive, insole 40, having a forepart and an arch portion, to a tuckboard near an arch portion end 42 of the insole so that the insole partially overlaps a top of the tuckboard. Also, the insole method includes affixing a substantially flat, fluid pressurized cushioning chamber to a top of the tuckboard to cover substantially the remaining portion of the top of tuckboard 60 which is not overlapped by insole 40. In addition, the method includes affixing a sockliner assembly to a top of the pressurized cushioning chamber and to a top of the insole.

With relatively thin cushioning element 30 being directly on top of tuckboard 60 and supported by the tuckboard 60, the present invention avoids a second element, such as cork to supplement the cushioning effect of foam rubber. With the single improved relatively thin cushioning element directly on top of thin tuckboard 60, the design constraint of a thin shoe sole can be met.

As seen in FIGS. 1–3, it is also preferable to have the thickness of the tuckboard decrease towards a front portion 62 of tuckboard 60. With such a structure, a portion of insole 40 can overlap and be disposed on a top of the front portion 62 of tuckboard 60. With this overlap, the tuckboard can be affixed to insole 40 and the rear of the insole (about 1–3 mm thick) can be raised slightly (about 1–2 mm) to be at nearly the same level as the heel cushioning element (approximately 4 mm) where insole 40 and heel cushioning element 30 are directly adjacent to each other. With insole 40 at nearly the same level as the cushioning element, this places sockliner assembly 10 on a more level surface while still obtaining the desired minimum thickness sole.

Sole 5 also can include a rib 100 disposed under the forepart portion of the insole. Rib 100 preferably curves about at least a ball area of the sole and extends no lower than 6 mm below a bottom of the forepart portion of the insole. In fact, rib 100 can be made as an integral extension from insole 40.

Figure 5:
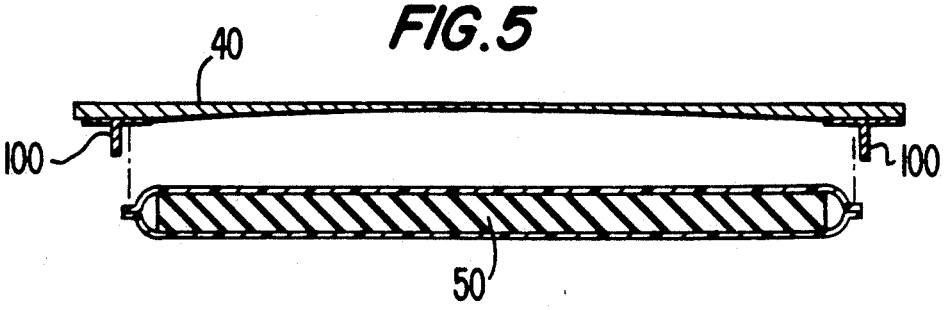
FIG. 5 is a sectional view along line 5—5 of FIG. 3 showing the insole and rib with the forepart cushioning element exploded therefrom.

As best illustrated in FIGS. 2 and 5, a forepart substantially flat cushioning element 50 is also included and disposed within a forepart area of the sole which is defined by the rib and extends no further downward than a lower end of the rib.

Further, the second pressurized cushioning element 50 is disposed substantially on the outsole. Thus, there is no need for the addition of cork to supplement cushioning. Having a separate forepart cushioning element 50 in a reduced center area below the ball of the foot and below insole 40 does not change the profile of, for example, a dress shoe and brings cushioning element 50 closer to the foot.

The preferred cushioning element 50 is pressurized with a fluid. More preferable is a tensile air chamber similar in construction properties to the multi-layered tensile air envelope or chamber 30 described for use in heel portion of the sole. With the forepart of the rib defining room for cushioning element 50 and with cork eliminated from the same cavity, a pressurized air chamber can be placed closer to the foot without adding to the effective height of sole 5.

Although this thin sole with excellent cushioning properties is preferably designed for meeting the small area (no more than 11 mm in thickness) design constraint of dress shoes, it can be applied to improve athletic or other type shoes where a thin sole profile is needed or desirable. Such a thin sole may be desirable in athletic shoes to bring the foot closer to the ground. For example, trail hiking or trail running are two applications where the user needs to have cushioning while still feeling the contours of the non-stable ground. Thus, the above described invention would be desirable for at least that athletic application and possibly many more.

Numerous characteristics, advantages, and embodiments of the invention have been described in detail and the foregoing description with reference to the accompanying drawings. However, the disclosure is illustrative only and the invention is not limited to the precise illustrated embodiments. Various changes and modifications may be effected therein by one skilled in the art without departing from the scope and spirit of the invention.

I claim:

1. A shoe sole comprising:

an outsole having forepart, arch and heel portion, said outsole having top and bottom surfaces;

a tuckboard disposed above said top surface of said outsole in said outsole heel portion;

a cushioning element disposed on said tuckboard, said cushioning element defining a chamber having top and bottom surfaces being substantially flat and planar even when said chamber is pressurized with a fluid; and an insole, disposed above said forepart and arch portions of said outsole and adjacent said pressurized cushioning chamber, wherein the top surface of said pressurized cushioning chamber is on substantially the same level as a top surface of said insole where said insole and said cushioning chamber are adjacent to each other, said bottom surface of said pressurized cushioning chamber always being further from the ground than all portions of said bottom surface of said outsole in said arch and heel portions.

2. A sole as in claim 1, wherein said insole partially overlaps a front portion of said tuckboard and said pressurized cushioning chamber extends over substantially the remainder of the tuckboard.

3. A sole as in claim 2, wherein the thickness of said tuckboard decreases towards the front portion of said tuckboard.

4. A sole as in claim 1, wherein said insole extends no further rearward on the outsole than a forwardmost portion of said pressurized cushioning chamber.

5. A sole as in claim 1, wherein the combination of said outsole, tuckboard, pressurized cushioning chamber and insole is no thicker than 11 mm.

6. A shoe sole comprising:

an outsole having forepart, arch and heel portions, said outsole having top and bottom surfaces;

an insole disposed only above the forepart and arch portions of said outsole, and having a rearwardmost portion defined by a tuckboard which is substantially planar and extends substantially across the width of said outsole, a forwardmost portion of said tuckboard substantially terminating at and attached to said rearwardmost portion of said insole; and a substantially flat cushioning element disposed above said tuckboard, having a forwardmost portion defining a planar end extending substantially across the width of said outsole and being directly adjacent said insole rearwardmost portion, wherein a top surface of said cushioning element is substantially flush with a top surface of said insole where said insole and said cushioning element are adjacent to each other, and wherein a bottom surface of said cushioning element is always further from the ground than all portions of said bottom surface of said outsole in said arch and heel portions.

7. A sole as in claim 6, further comprising:

a rib disposed under said forepart portion of said insole and curving about at least a ball area of said sole; and a second substantially flat cushioning element disposed within a forepart area of said sole which is defined by said rib and extending no further downward than a lower end of said rib.

8. A sole as in claim 7, wherein said rib extends no lower than 6 mm below a bottom of said forepart portion of said insole and said second cushioning element is pressurized with a fluid.

9. A sole as in claim 7, wherein both of said cushioning elements define chambers which are pressurized with a fluid and said second pressurized cushioning chamber is disposed directly onto said outsole.

10. A sole as in claim 6, wherein said cushioning element defines a chamber having top and bottom surfaces being substantially flat and planar even when said chamber is pressurized with a fluid.

11. A sole as in claim 6, wherein said cushioning element is no more than 2 mm thicker than said insole.

12. A sole as in claim 6, wherein the combination of said outsole, insole and cushioning element is no thicker than 11 mm.

* * * * *